US012006666B2

(12) United States Patent
Campomanes et al.

(10) Patent No.: US 12,006,666 B2
(45) Date of Patent: Jun. 11, 2024

(54) WEAR MEMBER RETENTION SYSTEM FOR AN IMPLEMENT

(71) Applicant: Caterpillar Inc., Peoria, IL (US)

(72) Inventors: Patrick Simon Campomanes, Washington, IL (US); Adam M. Dean, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/114,448

(22) Filed: Feb. 27, 2023

(65) Prior Publication Data

US 2023/0220653 A1 Jul. 13, 2023

Related U.S. Application Data

(63) Continuation of application No. 16/541,663, filed on Aug. 15, 2019, now Pat. No. 11,613,875, which is a continuation of application No. 15/481,742, filed on Apr. 7, 2017, now Pat. No. 10,407,880.

(60) Provisional application No. 62/354,215, filed on Jun. 24, 2016.

(51) Int. Cl.
*E02F 9/28* (2006.01)

(52) U.S. Cl.
CPC ..... *E02F 9/2833* (2013.01); *E02F 9/2816* (2013.01)

(58) Field of Classification Search
CPC ..... E02F 9/2816; E02F 9/2833
See application file for complete search history.

(56) References Cited

U.S. PATENT DOCUMENTS

| | | | | |
|---|---|---|---|---|
| 2,167,425 | A | 7/1939 | Page | |
| 5,713,145 | A | 2/1998 | Ruvang | |
| 6,209,238 | B1 | 4/2001 | Ruvang | |
| 7,472,503 | B2 | 1/2009 | Maher | |
| 7,578,081 | B2 | 8/2009 | Bearden et al. | |
| 8,943,718 | B2 | 2/2015 | Ruvang | |
| 9,315,972 | B2 | 4/2016 | Anisy | |
| 9,631,346 | B2 | 4/2017 | Tasovski | |
| 9,632,200 | B2 | 4/2017 | Tasovski | |
| 10,246,856 | B2 | 4/2019 | Rol Corredor | |
| 10,378,187 | B2 | 8/2019 | Flahive | |
| 10,407,880 | B2 | 9/2019 | Campomanes | |
| 11,066,812 | B2 | 7/2021 | Jakubisin | |
| 11,427,990 | B2 | 8/2022 | Kunz | |
| 11,613,875 | B2 * | 3/2023 | Campomanes | E02F 9/2833 37/456 |
| 2005/0229441 | A1 | 10/2005 | Maher | |
| 2006/0265916 | A1 | 11/2006 | Carpenter | |
| 2008/0005940 | A1 | 1/2008 | Ollinger | |

(Continued)

FOREIGN PATENT DOCUMENTS

| | | |
|---|---|---|
| CN | 102597381 | 7/2012 |
| CN | 102720244 | 10/2012 |

(Continued)

*Primary Examiner* — Gary S Hartmann

(57) ABSTRACT

A lug member is provided for a wear member retention system for an implement. The lug member includes an elongated body having a length dimension. A wear member engagement portion extends toward a distal end of the elongated body. A compression bolt assembly engaging portion is adjacent a proximal end of the elongated body. The compression bolt assembly engaging portion defines at least one bore configured to receive a compression bolt.

9 Claims, 9 Drawing Sheets

(56) References Cited

U.S. PATENT DOCUMENTS

| | | | |
|---|---|---|---|
| 2011/0072693 | A1 | 3/2011 | Knight |
| 2013/0307316 | A1 | 11/2013 | Roetsch |
| 2015/0121729 | A1 | 5/2015 | Kunz |
| 2015/0211214 | A1 | 7/2015 | Dallard |
| 2021/0332567 | A1 | 10/2021 | Kunz |

FOREIGN PATENT DOCUMENTS

| | | |
|---|---|---|
| CN | 103917720 | 7/2014 |
| CN | 203768980 | 8/2014 |
| CN | 104603373 | 5/2015 |
| CN | 105705707 | 6/2016 |
| JP | 2010526953 | 8/2010 |

* cited by examiner

WEAR MEMBER RETENTION SYSTEM FOR AN IMPLEMENT

CROSS-REFERENCE TO RELATED APPLICATIONS

This application is a continuation of U.S. patent application Ser. No. 16/541,663, filed Aug. 15, 2019, which is a continuation of U.S. patent application Ser. No. 15/481,742, filed Apr. 7, 2017, which claims the benefit of priority to U.S. Provisional Patent Application No. 62/354,215, filed Jun. 24, 2016, the contents of all of which are hereby expressly incorporated by reference in their entireties.

TECHNICAL FIELD

The present disclosure relates generally to wear member retention and, more particularly, to a wear member retention system for an implement.

BACKGROUND

Earth-working and excavating machines, such as wheel loaders, cable shovels, drag lines, electric rope shovels (ERS), excavators, and front shovels, include implements generally used for digging into, ripping, or otherwise moving earth, rocks, debris, or other materials. Such implements commonly are various types of buckets having shapes and dimensions dependent on the type of bucket and size of the machine employing a particular bucket. These implements are subjected to abrasion and impacts that cause them to wear. To prolong the useful life of these implements, various shrouds, or wear members, can be connected to the earth-working and excavating implements at areas which experience wear. These wear members may be connected to the implements using a retention system that permits replacement of the wear members when they become worn to the extent that they should be replaced.

Some implements which have been provided with wear members have required that one or more components be welded to the implement in order to permit retention of the wear member in place on the implement. Other implements have employed various multi-component retaining systems wherein one or more of the components must be hammered in place to hold a wear member in position on an implement. The use of welded components that may need frequent replacement themselves due to extreme conditions of wear may be problematic, particularly where maintenance must be done at a work site. The use of retaining systems that are required to be hammered in place also may be problematic and difficult to put in place and remove. A shroud/wear member retention system that is both weldless and hammerless, that is to say, one that does not require retention parts to be welded to the implement and does not require retention parts that must be hammered in place, would be both beneficial and desirable. In addition, an assembled shroud/wear member retention system should have cooperating components that are arranged in a manner to avoid premature failure.

One retaining arrangement for a wear member is disclosed in U.S. Pat. No. 5,713,145 to Ruvang that issued on Feb. 3, 1998 ("the '145 patent"). Specifically, the '145 patent discloses a bucket that includes an attachment system for a shroud, or wear member, that includes a component that the '145 patent characterizes as a retainer, the retainer being welded or otherwise fastened to an implement lip. The '145 patent discloses that a J-shaped bolt may be inserted through an opening formed vertically through a rear portion of the wear member and rotated until a threaded end of the bolt is horizontal. The J-shaped bolt may then be received in a channel of the retainer of the '145 patent when the wear member is installed on the lip portion of the bucket. Subsequently, washers, a compression member, for example a spring, and a nut may then be installed over the threaded end of the J-shaped bolt and bear against the retainer to bias the wear member toward the lip of the bucket.

Although acceptable for some applications, the wear member retaining arrangement of the '145 patent may not have broad applicability. In particular, the wear member retaining arrangement of the '145 patent may not be sufficiently robust to endure the extreme conditions of use in large, heavy-duty machines. For example, the J-bolt of the '145 patent is inherently under tension. Tightening the J-bolt enough to sufficiently secure wear members onto an implement may cause metal fatigue and bolt failure, resulting in dislodgement of the wear member and implement damage, especially with heavy-duty use in large machines. In addition, the system disclosed in the '145 patent is specialized for use with the welded-on, or otherwise secured, retainers on the implement lip. This may be problematic when such retainers require repair and/or replacement, particularly during field operations.

The disclosed wear member retention system is directed to overcoming one or more of the problems set forth above.

SUMMARY

According to one exemplary aspect, the present disclosure is directed to a lug member for a wear member retention system for an implement. The lug member includes an elongated body having a length dimension. The lug member also includes a wear member engagement portion extending toward a distal end of the elongated body. The lug member also includes a compression bolt assembly engaging portion adjacent a proximal end of the elongated body, wherein the compression bolt assembly engaging portion defines at least one bore configured to receive a compression bolt.

According to another exemplary aspect, the present disclosure is directed to a wear member retention system. The wear member retention system includes a boss configured to engage an aperture in an implement. The wear member retention system also includes a lug member configured to engage a wear member aperture and the boss and including a compression bolt assembly engaging portion. The wear member retention system also includes a compression bolt assembly extending between a portion of the boss and the compression bolt assembly engaging portion of the lug member and configured to force the compression bolt assembly engaging portion of the lug member away from the portion of the boss.

According to yet another exemplary aspect, the present disclosure is directed to a system for retaining a wear member on a bucket. The system includes a bucket including a container portion and a lip portion and defining an aperture adjacent the lip and extending from an inner surface of the bucket to an outer surface of the bucket. The system also includes a boss including a head element, a guide element extending in a first direction from the head element, and a leg element extending in a second direction from the head element, wherein the leg element is configured to extend into the aperture of the bucket. The system also includes a lug member including a wear member engagement portion configured to engage an aperture of a wear member, a boss engagement portion configured to engage the guide element and the head element, and a compression bolt assembly engaging portion. The system also includes a compression bolt assembly including two compression bolts between the head element and the compression bolt assembly engaging portion of the lug member and configured to force the compression bolt assembly engaging portion of the lug member away from the head element.

DETAILED DESCRIPTION

Figure 1:
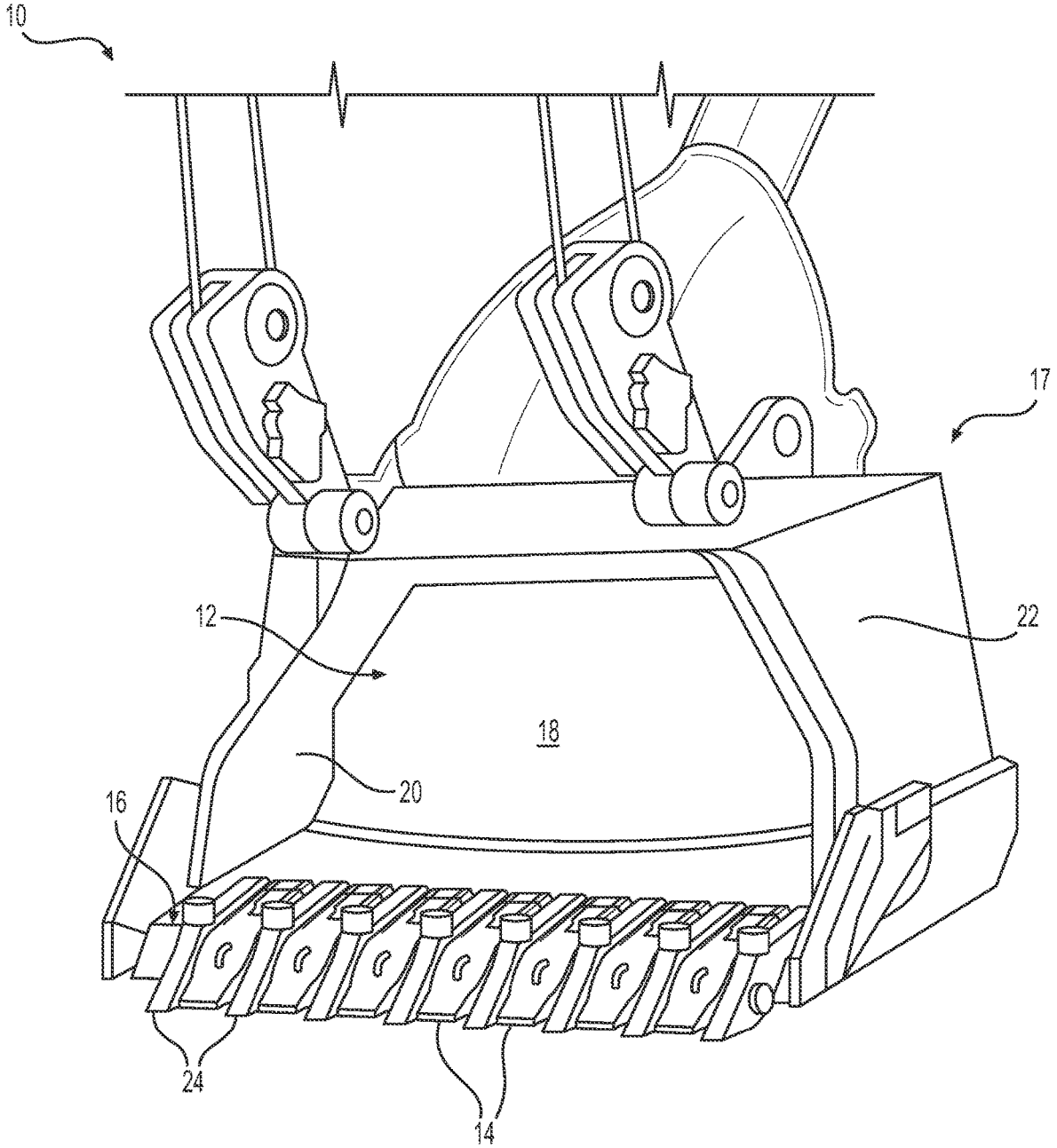
FIG. 1 illustrates an exemplary implement in the form of a bucket.

FIG. 1 illustrates an implement 10 in the form of a bucket 12. Bucket 12 may include one or more wear members 14 and wear member retention systems in accordance with disclosed embodiments. While implement 10 is illustrated in FIG. 1 and described as a bucket 12, it should be understood that the disclosed embodiments of a wear member retention system may be employed in connection with implements other than a bucket. For example, wear member retention systems according to disclosed embodiments may be employed on a separate ground engaging edge or lip member that may then be attached to a bucket, scoop or other excavating or material handling implement. Bucket 12 may be of the type employed in various machines such as, for example, an electric rope shovel (shown in FIG. 1), a dragline, a hydraulic excavator, a backhoe, a tracked or wheeled loader, etc., and may be shaped somewhat differently depending on the type of machine in which it is employed. Some buckets or other implements may include one or more apertures that may receive various fasteners or retaining members intended to secure replaceable wear members of various types thereto. Such existing apertures may conveniently be used in connection with disclosed embodiments of a wear member retention system.

Bucket 12 may include a lip portion 16, sometimes referred to as a digging edge, cutting edge, edge member, etc., and one or more wall members defining a container portion 17 for material. For example, container portion 17 of bucket 12 may include a primary wall member 18 which may serve as a bottom and back, and two side wall members 20 and 22. Other bucket forms are contemplated, depending on the type of machine on which the bucket may be employed. Lip portion 16 may be provided with a plurality of tooth assemblies 24, and with a plurality of wear members 14. For example, a wear member 14 may be provided between each pair of adjacent tooth assemblies 24. Lip portion 16 may be detachable from bucket 12, e.g., secured by bolts or other fasteners, or it may be a fixed component of bucket 12, e.g., welded to primary wall member 18.

Figure 2:
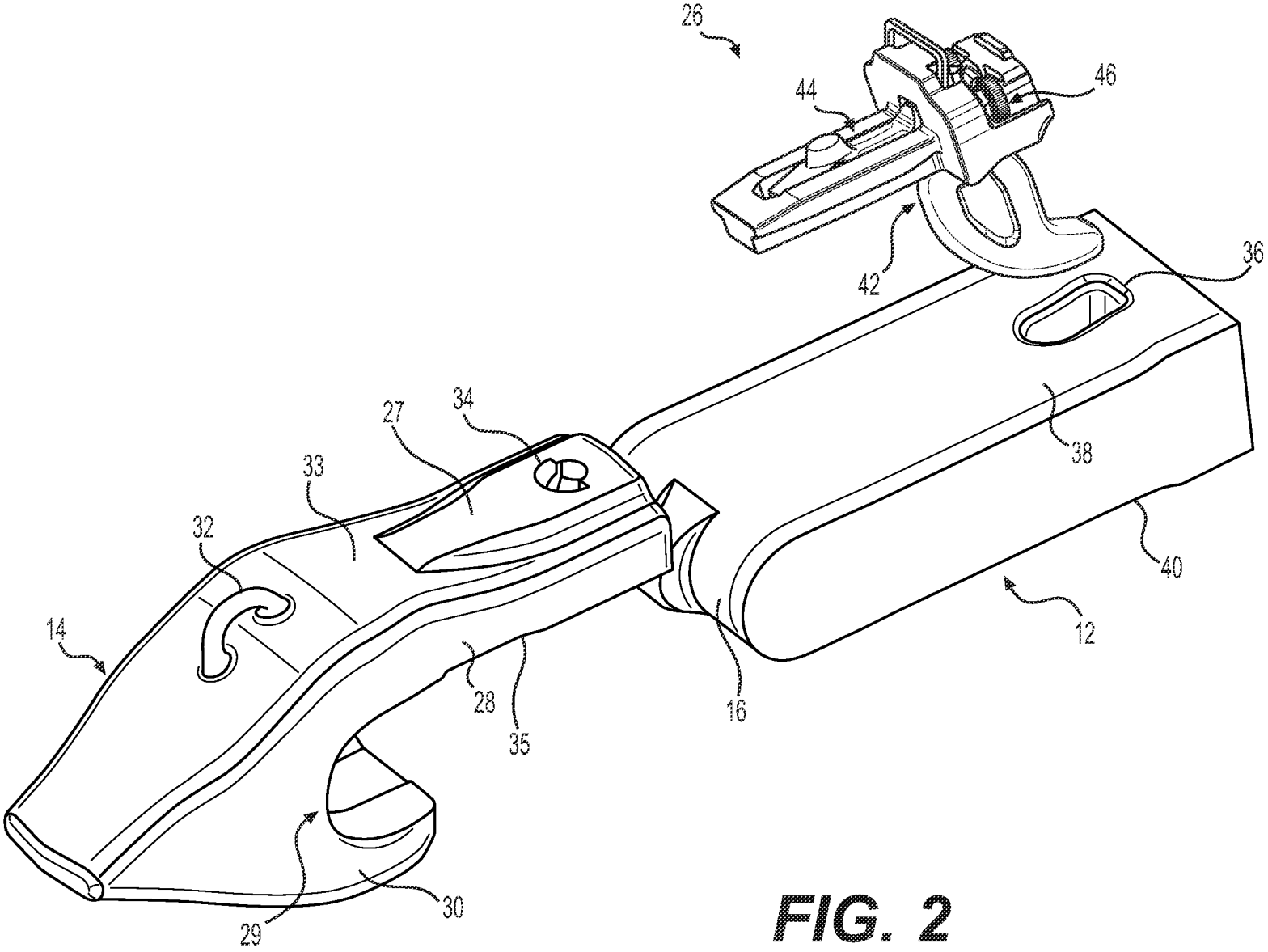
FIG. 2 illustrates an exploded view of a wear member, a portion of an implement, and components of a wear member retention system according to disclosed embodiments.

FIG. 2 is an exploded view illustrating a wear member 14, a lip portion 16 of a bucket 12, and a wear member retention system 26 including cooperating components to be described in detail. Wear member 14 may be designed to protect a lip portion 16 from direct impact and direct contact with abrasive material that bucket 12 may come into contact with. Wear member 14 may include an inner leg 28 extending into bucket 12 and an outer leg 30 outside bucket 12. Inner leg 28 and outer leg 30 may join and form a bight 29 generally conforming to surfaces of lip portion 16 of bucket 12. Wear member 14 may include a lifting eye 32 to aid manipulation of wear member 14, for example during installation and removal from a bucket 12. Wear member 14 also may include an aperture 34 defined by wear member 14 and extending through wear member 14, e.g., through a profiled portion 27 on inner leg 28 of wear member 14, and from a first surface 33 to a second surface 35. Aperture 34 may be employed in use of a wear member retention system 26 in accordance with disclosed embodiments. Bucket 12 may define an aperture 36 adjacent or on lip portion 16 and extending from an inner surface 38 of bucket 12 to an outer surface 40 of bucket 12. Wear member retention system 26 may include a boss 42, a lug member 44, and a compression bolt assembly 46, all to be described in more detail subsequently.

Figure 3:
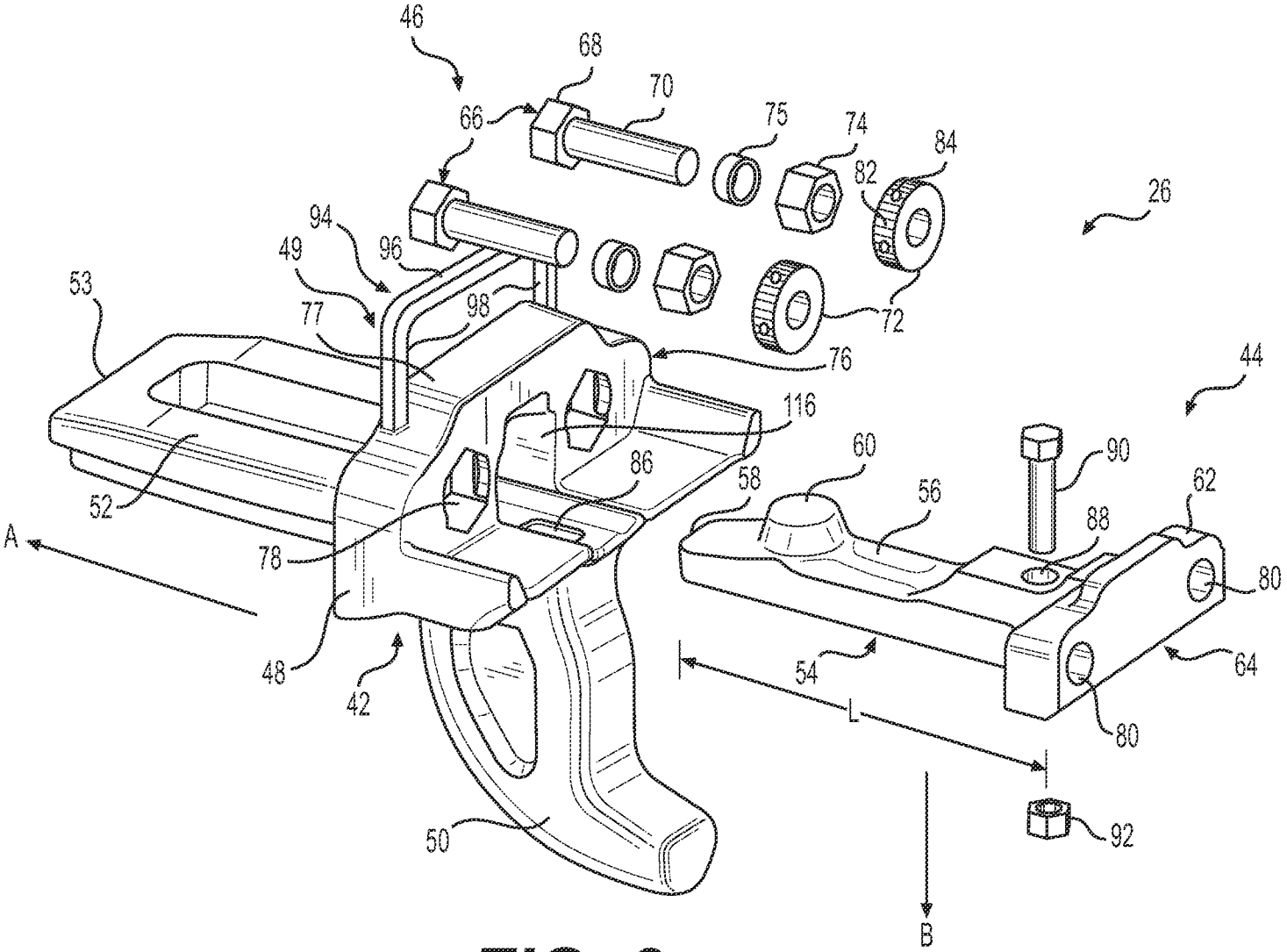
FIG. 3 illustrates an exploded view of components of a wear member retention system according to disclosed embodiments.

FIG. 3 is an exploded view illustrating components of wear member retention system 26, including boss 42, lug member 44, and compression bolt assembly 46. Boss 42 may include a head element 48, a leg element 50, and a guide element 52. Guide element 52 of boss 42 may extend from head element 48 in a first direction A and may be configured to cooperate with a portion of a wear member 14 that may be employed with bucket 12. For example, guide element 52 typically may extend from a distal side 49 of head element 48 to a distal end 53 of guide element 52 approximately 197 mm, or between 190 mm and 210 mm, for example. Leg element 50 of boss 42 may extend from head element 48 in a second direction B and may be configured to be inserted in aperture 36 of bucket 12. Head element 48 of boss 42 may be characterized as the juncture area of leg element 50 and guide element 52, and along with guide element 52, may be configured to cooperate with lug member 44 and compression bolt assembly 46.

Lug member 44 may include an elongated body 54 having a length dimension L. Lug member 44 may include a wear member engagement portion 56 extending toward a distal end 58 of elongated body 54. A wear member engaging protrusion 60 may extend from wear member engagement portion 56 adjacent distal end 58. Wear member engaging protrusion 60 may be shaped so as to have a generally frustoconical profile. Alternatively, wear member engaging protrusion 60 may have other profiles, such as cylindrical, oval, polygonal, etc. Lug member 44 also may include a compression bolt assembly engaging portion 62 adjacent a proximal end 64 of elongated body 54.

Compression bolt assembly 46 may include at least one compression bolt 66. For example, in an embodiment, compression bolt assembly 46 may include two compression bolts 66 and each compression bolt 66 may be substantially identical to the other. Compression bolt 66 may include a head 68, for example a hex head, and a threaded shaft 70. Threaded shaft 70 may be threaded along its entire length, or it may be threaded only partially along its length. Compression bolt assembly 46 also may include thumb nuts 72 and jam nuts 74 for each of compression bolts 66. Compression bolt assembly 46 also may include one or more spacers 75 positioned, for example, between head 68 and jam nut 74.

A portion 76 of boss 42, for example a portion of head element 48, may include at least one recess 78 configured to receive a head 68 of a compression bolt 66. The recess 78 for each compression bolt 66 may be shaped to engage the head 68 of a compression bolt 66 so as to prevent rotation of the compression bolt 66 relative to boss 42. For example, where a bolt 66 includes a hex head, recess 78 may be shaped at least partially hexagonally in order to closely engage the hex head and prevent rotation of the compression bolt 66. Alternatively, where bolt 66 includes a square head, recess 78 may be shaped so as to closely engage the square head and prevent rotation of compression bolt 66. Recess 78 may be a hexagonal, square, or otherwise shaped blind bore within head element 48, or it may be a slot open to a surface 77 of head element 48 and having sides capable of confining head 68 of compression bolt 66 against rotation. Compression bolt assembly engaging portion 62 of lug member 44 may define at least one bore 80 configured to receive threaded shaft 70 of a compression bolt 66. Bore 80 may extend generally parallel to the length dimension L of elongated body 54. In the embodiment illustrated in FIG. 3, first and second bores 80 may be included in compression bolt assembly engaging portion 62.

Thumb nut 72 of each compression bolt 66 may be configured to be finger tightened during use of compression bolt assembly 46. Each thumb nut 72 may include a knurled surface 82 to facilitate turning without a tool. Surface textures or profiles other than knurling that may be conducive to finger tightening also may be employed and are contemplated. Alternatively or additionally, each thumb nut 72 may be configured to receive a tool for turning. For example, each thumb nut 72 may include one or more apertures 84 adapted to receive a tool for apply leverage for turning thumb nut 72. Jam nut 74 of each compression bolt 66 may be configured to be tightened by a tool. Jam nut 74 may be, for example, a hex nut and may be tightened against thumb nut 72 in order to inhibit loosening of thumb nut 72.

A recess 86 may be defined by boss 42, for example adjacent the juncture of leg element 50 and head element 48, and a third bore 88 may be defined by the elongated body 54 of lug member 44. Third bore 88 may extend transverse to first and second bores 80 in compression bolt assembly engaging portion 62 and may extend in second direction B transverse relative to length dimension L of elongated body 54. A retention bolt 90 may extend through third bore 88 and cooperate with a nut 92. Retention bolt 90 may be of sufficient length to extend through third bore 88 and into recess 86 when lug member 44 is assembled with boss 42. Upon assembly of lug member 44 with boss 42 and compression bolt assembly 46, retention bolt 90 may be threaded into nut 92, and retention bolt 90 may extend into recess 86 in order to inhibit separation of the assembled components during transport or when being manipulated to engage a bucket 12 and wear member 14.

Still referring to FIG. 3, boss 42 may include a lifting handle 94 to aid manipulation of boss 42 either alone or with lug member 44 and compression bolt assembly 46 assembled with boss 42. Lifting handle 94 may take various shapes suitable to enable cooperation with a lifting device. For example, lifting handle 94 may be a low-profile loop having a linear member 96 connected to head element 48 of boss 42 by two short legs 98. It will be understood, and it is within the scope of this disclosure, that lifting handle 94 may be T-shaped, formed as a curved loop, or take other shapes.

Figure 4:
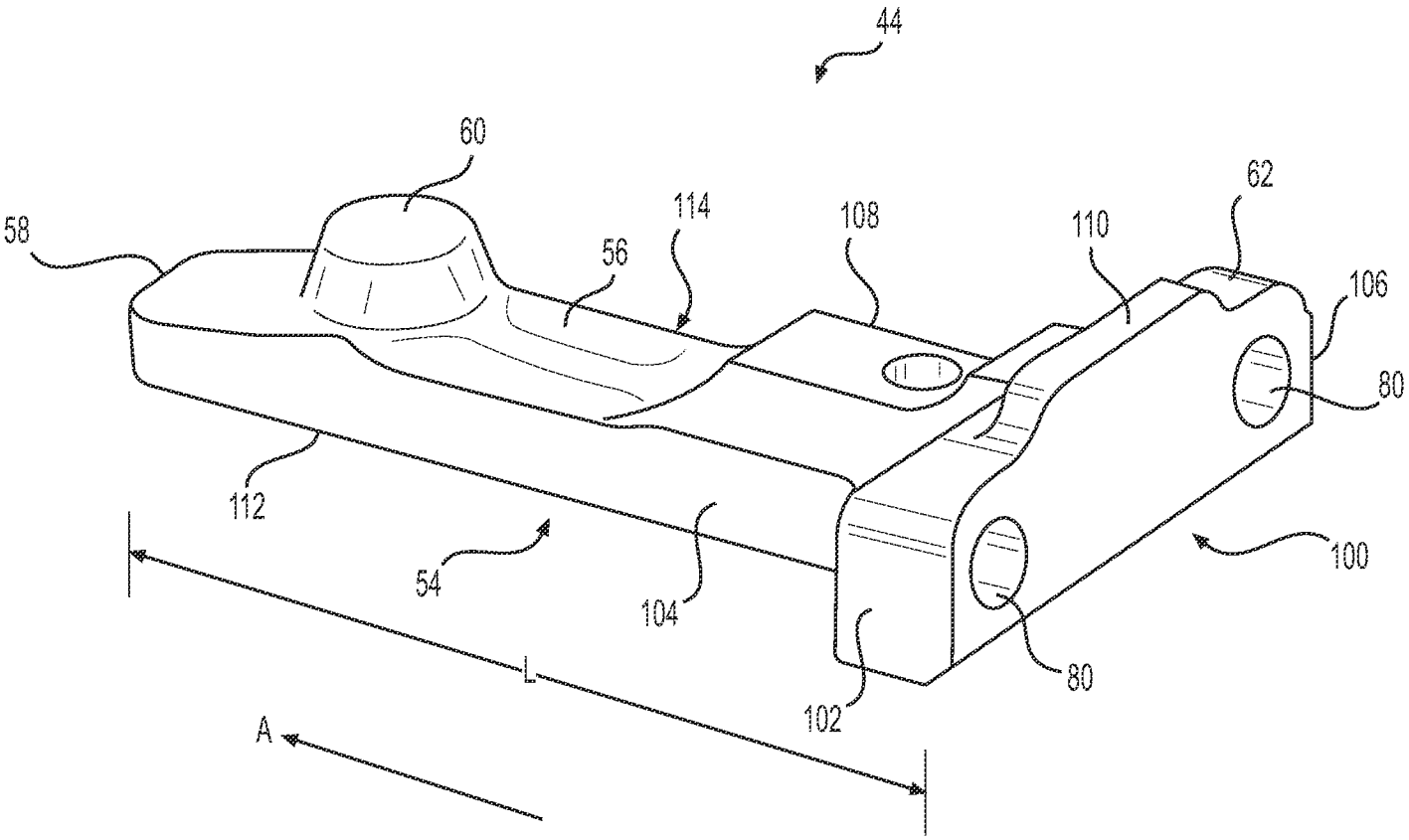
FIG. 4 illustrates a lug member according to disclosed embodiments.

FIG. 4 illustrates a perspective view of lug member 44 in isolation and enlarged to better illustrate certain aspects. Compression bolt assembly engaging portion 62 includes a transverse member 100 extending generally perpendicular to the length dimension L of elongated body 54. Transverse member 100 includes a first lateral arm 102 extending a first distance from a first lateral side 104 of lug member 44, and a second lateral arm 106 extending a second distance from a second lateral side 108 of lug member 44. The first distance may be generally equal to the second distance. Alternatively, first and second lateral arms 102 and 106 may extend different distances from respective lateral sides 104 and 108 of lug member 44. A first bore 80 may be defined by compression bolt assembly engaging portion 62 in first lateral arm 102 and a second bore 80 may be defined by compression bolt assembly engaging portion 62 in second lateral arm 106.

Transverse member 100 may have a thickness dimension extending in first direction A for a portion of length dimension L of elongated body 54. Transverse member 100 may include a pull-back ledge 110 extending from transverse member. Pull-back ledge 110 also may include a thickness dimension extending in first direction A for a portion of length dimension L of elongated body 54. The thickness dimension of pull-back ledge 110 may be less than the thickness dimension of transverse member 100.

Lug member 44 may include a boss engaging surface 112 configured to engage a surface of boss 42. Boss engaging surface 112 may be generally planar. Lug member 44 also may include a profiled surface 114 opposite boss engaging surface 112. Profiled surface 114 may include surface portions defining features of lug member 44 that enable wear member retention system 26 to effectively retain a wear member 14 on bucket 12 in cooperation with boss 42 and compression bolt assembly 46. For example, profiled surface 114 may include a surface portion defining the compression bolt assembly engaging portion 62, a portion for extending through a boss aperture 116 (FIG. 3), and a portion defining wear member engaging protrusion 60.

Figure 5:
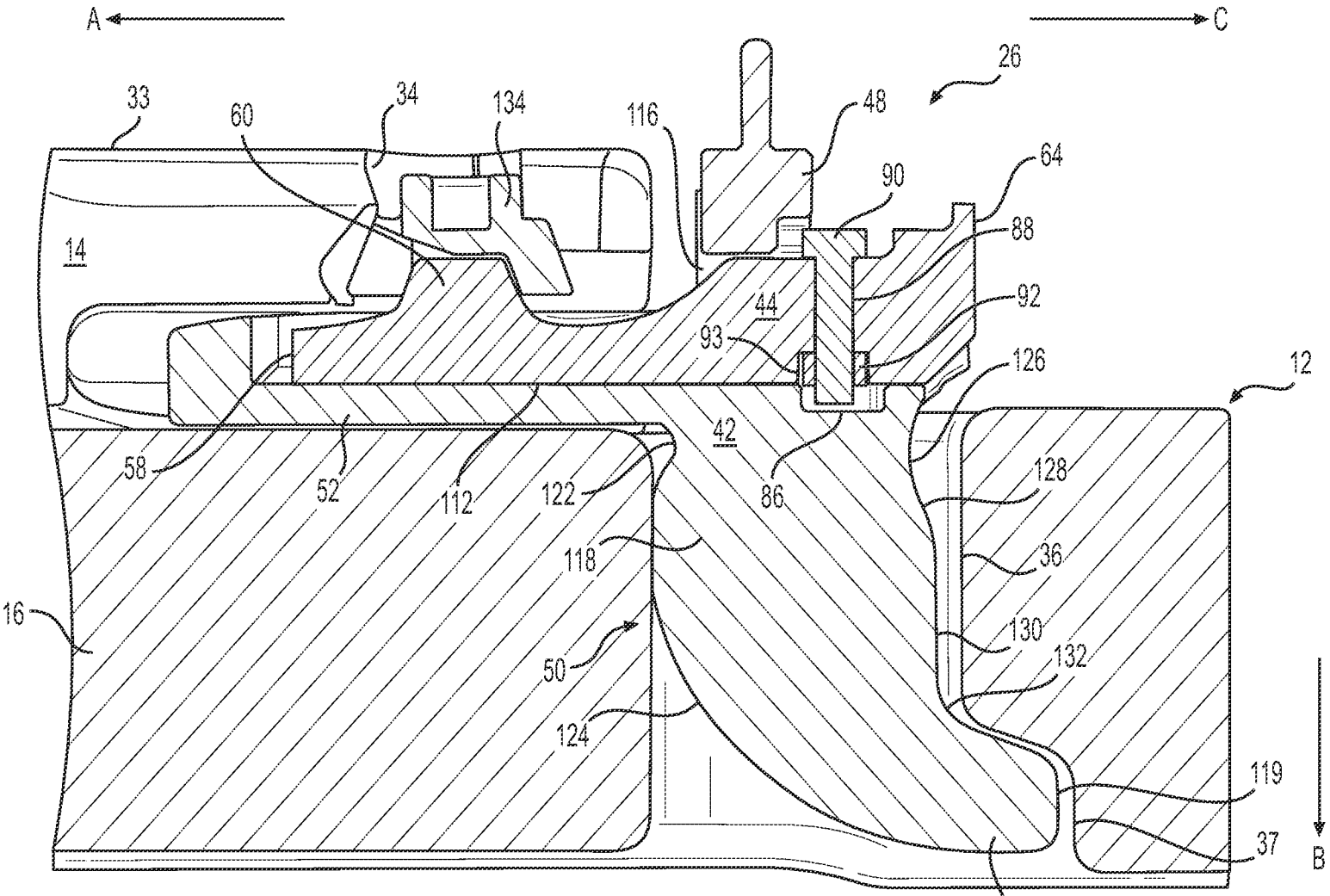
FIG. 5 illustrates a cross-sectional view of a boss and lug member according to disclosed embodiments installed on an implement and retaining a wear member.

FIG. 5 is a simplified cross-sectional view along a centerline extending in direction A of an assembled wear member retention system 26 installed on a bucket 12 and retaining a wear member 14. Compression bolt assembly 46 is not visible in FIG. 5. Leg element 50 may include a first portion 118 that may be installed in aperture 36, and a second portion 120 extending from the first portion 118 generally in a third direction C opposite from first direction A to an end surface 119 and into an offset portion 37 of aperture 36. Leg element 50 may include a first curved surface portion 122 on first portion 118 and extending from guide element 52. Leg element 50 may include a second curved surface portion 124 adjoining and curved oppositely from first curved surface portion 122 and extending along first portion 118 and along second portion 120. Leg element 50 may include a third curved surface portion 126, curved oppositely from first curved surface portion 122, and extending from head element 48. Leg element 50 may include a fourth curved surface portion 128 adjoining and curved oppositely from third curved surface portion 126 and extending along first portion 118 to a generally planar surface portion 130. Leg element 50 may include a fifth curved surface portion 132 curved oppositely from fourth curved surface portion 128 and extending from generally planar surface portion 130 to second portion 120.

Leg element 50 may extend from guide element 52 and head element 48 approximately 160 mm, for example. The maximum extent of leg element 50 in direction C from second curved surface portion 124 to end surface 119 may be on the order of 150 mm. The radius of curvature of first curved surface portion 122 may be on the order of 8.5 mm, and may be between 7 mm and 10 mm, for example. The radius of curvature of second curved surface portion 124 may be approximately 120 mm, and may be between 110 mm and 130 mm, for example. The radius of curvature of third curved surface portion 126 may be approximately 65 mm, and may be between 60 mm and 70 mm, for example. The radius of curvature of fourth curved surface portion 128 may be approximately 50 mm, and may be between 40 mm and 60 mm, for example. The radius of curvature of fifth curved surface portion 132 may be approximately 20 mm, and may be between 10 mm and 30 mm, for example. The dimensions given for leg element 50 may be typical examples, but they are not intended to be limiting since dimensions may vary based on the size of machine and/or implement on which the disclosed wear member retention system 26 may be employed, and/or based on the size and shape of an aperture 36 with which boss 42 may be associated, for example.

FIG. 5 also illustrates retention bolt 90 extending through bore 88 in lug member 44 and secured to lug member 44 by nut 92. Nut 92 may be situated within a cavity 93 formed in boss engaging surface 112 of lug member 44. Retention bolt 90 may be of sufficient length to extend into recess 86. When lug member 44 and boss 42 are assembled, as illustrated in FIG. 5, for example, retention bolt 90 inhibits separation of lug member 44 and boss 42. As illustrated in FIG. 5, recess 86 is enlarged relative to a diameter of retention bolt 90 so as to extend in directions A and C for a distance greater that a diameter of retention bolt 90. Advantageously, the enlargement of recess 86 both allows for adjustment of lug member 44 relative to boss 42 and allows compensation for wear of parts over time during use of wear member retention system 26. The depth and width of recess 86 may vary. A typical depth of recess in direction B may be 20 mm, and it may vary between 15 mm and 25 mm, for example. A typical width of recess 86 in directions A and C may be on the order of 25.4 mm, and it may vary between 20 mm and 30 mm, for example.

FIG. 5 also diagrammatically illustrates the cooperative relationship of lug member 44, boss 42, and wear member 14. Guide element 52 of boss 42 may extend in direction A toward lip portion 16 of bucket 12. Lug member 44 may extend from its proximal end 64 through boss aperture 116 and along guide element 52 to distal end 58 with boss engaging surface 112 in engagement with guide element 52. Wear member engaging protrusion 60 may cooperate with aperture 34 of wear member 14 by projecting into aperture 34. A securing component 134 may be separately inserted into aperture 34 from first surface 33 of wear member 14 and engage wear member engaging protrusion 60 to further ensure retention of wear member 14 on lip portion 16 of bucket 12.

Figure 6:
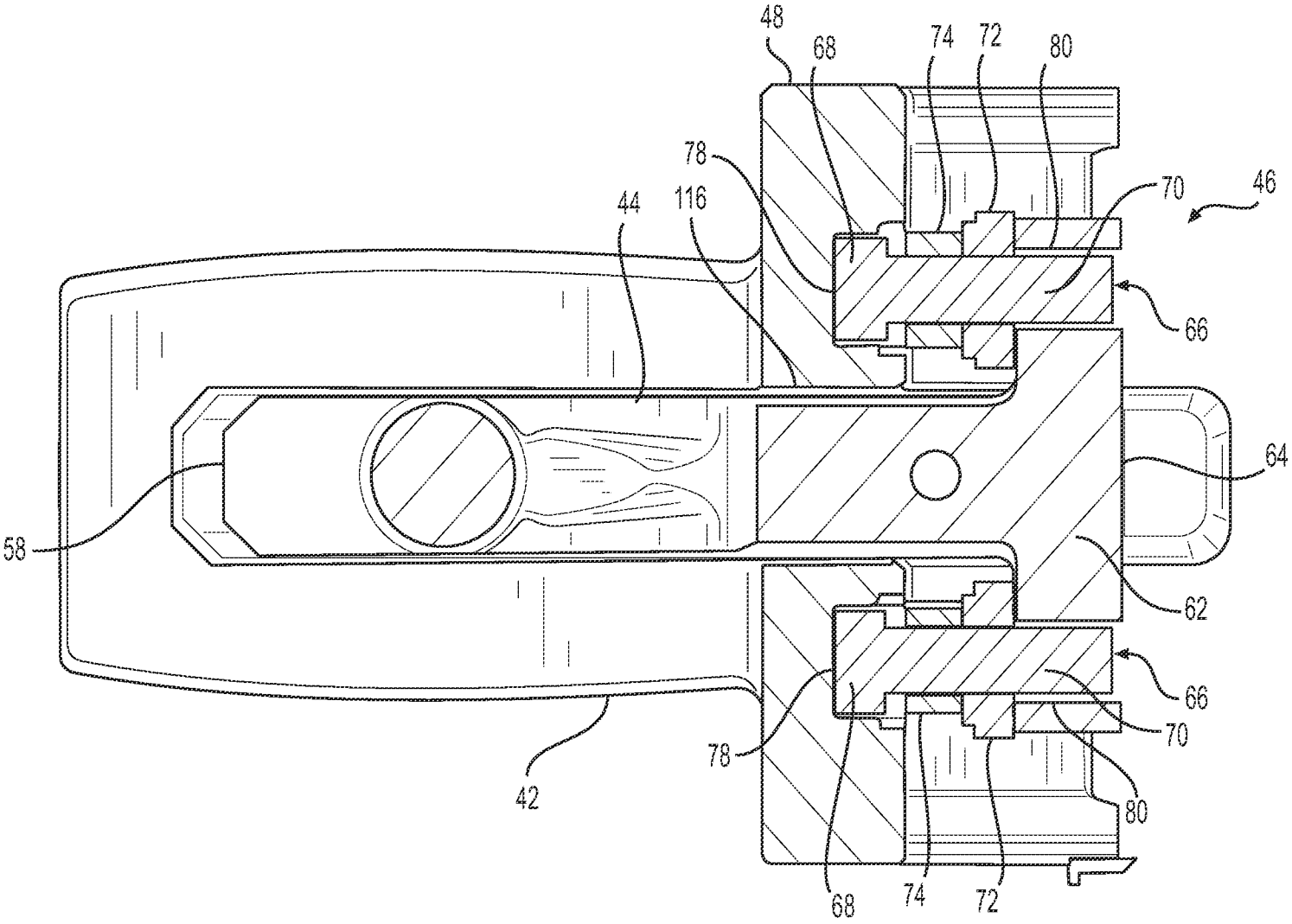
FIG. 6 illustrates a plan view of a wear member retention system according to disclosed embodiments.

FIG. 6 is a cross-sectional plan view illustrating boss 42, lug member 44, and compression bolt assembly 46 in an assembled arrangement. As viewed in FIG. 6, heads 68 of compression bolts 66 are illustrated captured within recesses 78. Thumb nuts 72 are illustrated engaged against compression bolt assembly engaging portion 62 of lug member 44 after having been finger tightened on threaded shafts 70 to that position. Jam nuts 74 are illustrated engaged against thumb nuts 72, for example by a suitable tightening tool, to prevent undesired loosening of thumb nuts 72. Optional spacers 75 (FIG. 3) are not illustrated in FIG. 6, but in situations where needed or desired, spacers 75 would be located between heads 68 and jam nuts 74. Threaded shafts 70 are illustrated passing freely through unthreaded bores 80 in compression bolt assembly engaging portion 62. Lug member 44 is illustrated extending from proximal end 64 to distal end 58 and passing through boss aperture 116 in head element 48 of boss 42.

Figure 7:
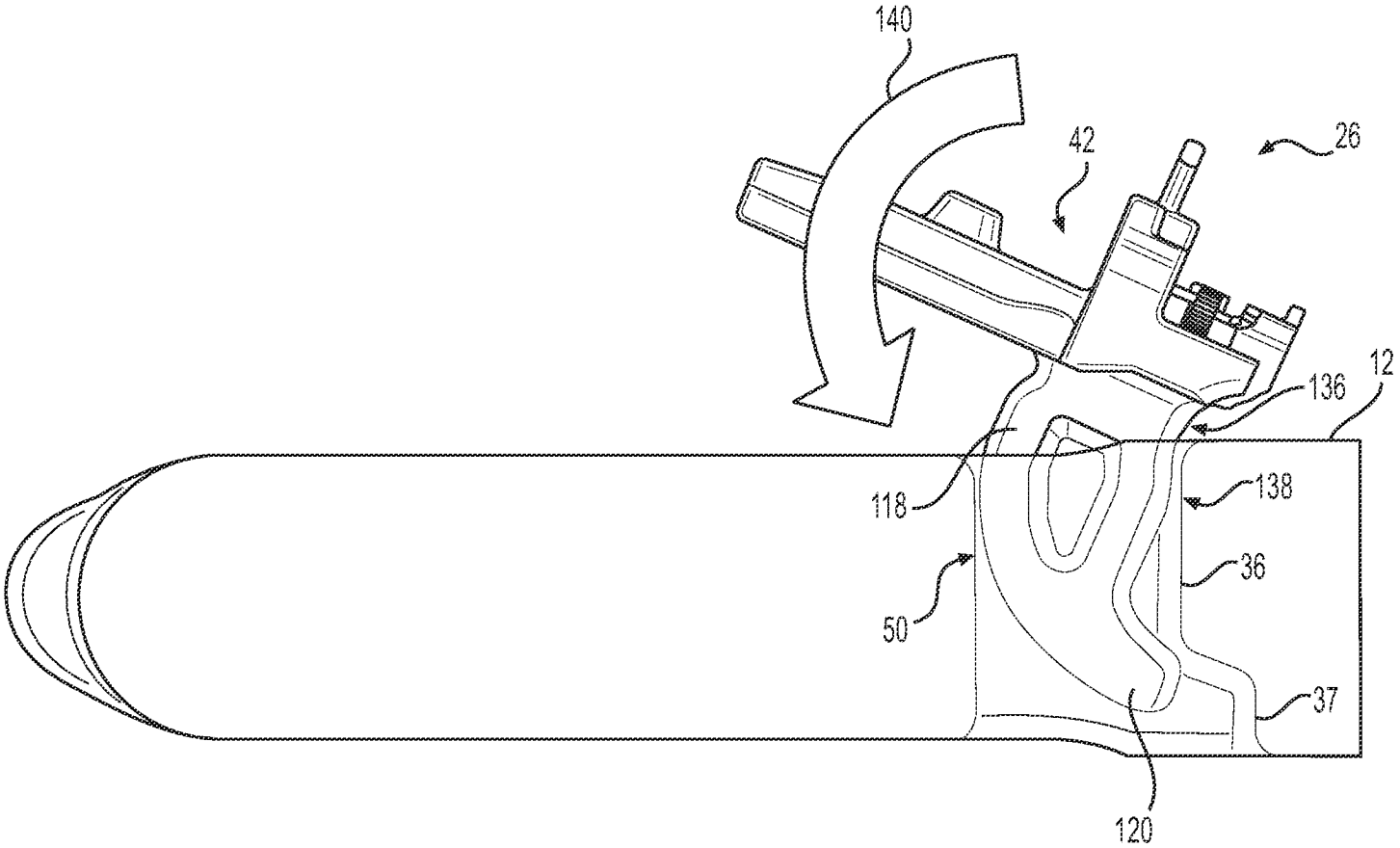
FIG. 7 illustrates a wear member retention system according to disclosed embodiments in the process of being installed on an implement.

FIG. 7 illustrates insertion of wear member retention system 26 into an aperture 36 of a bucket 12, for example. Third curved portion 126, described in connection with FIG. 5, effectively provides an installation recess 136 on first portion 118 of leg element 50 at a proximal side 138 of boss 42. The concave curved configuration of installation recess 136 may facilitate insertion of wear member retention system 26 into aperture 36 as it is moved into position, along the direction of arrow 140, until second portion 120 is inserted into offset portion 37.

Figure 8:
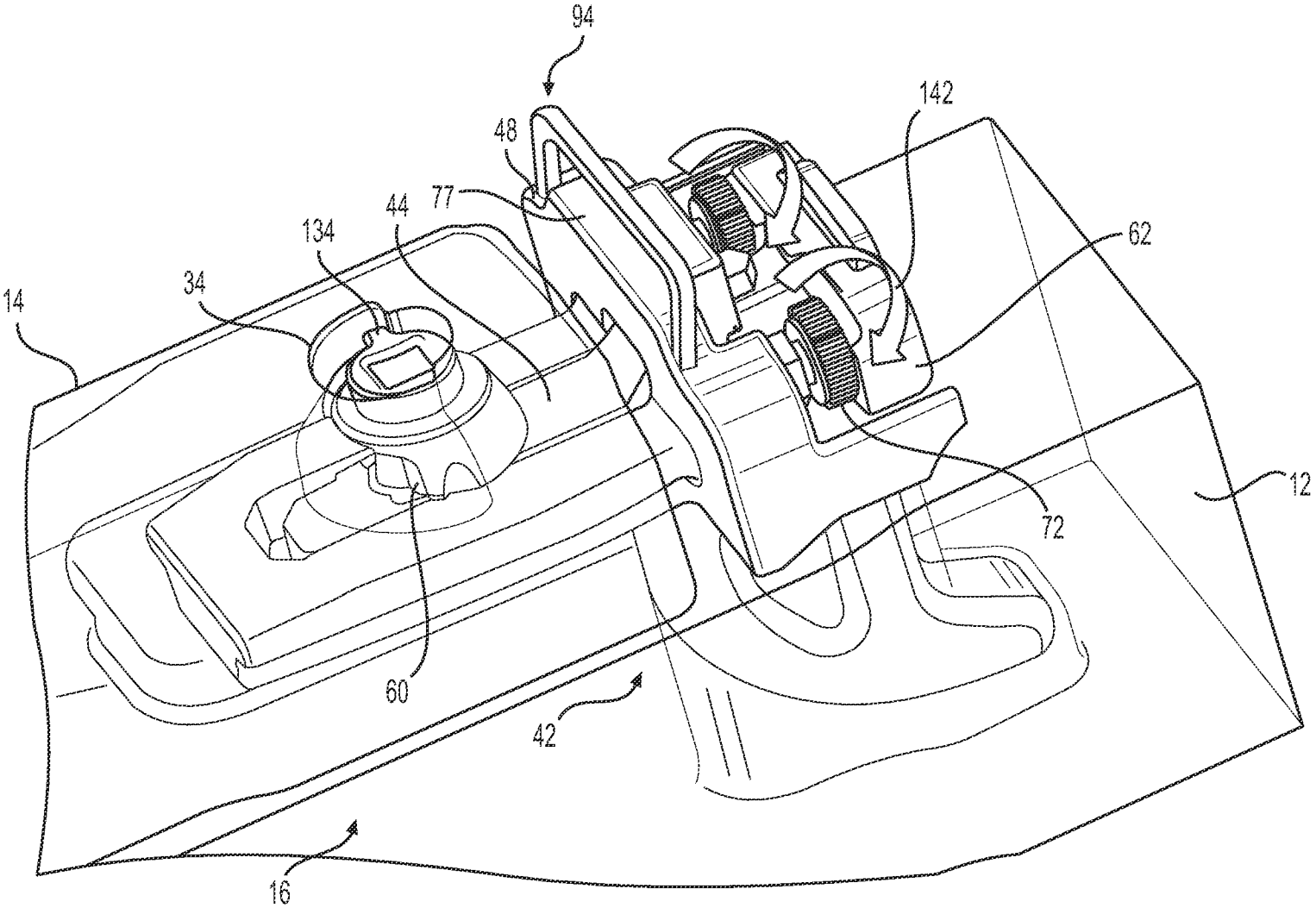
FIG. 8 illustrates a perspective view showing aspects of a wear member retention system according to disclosed embodiments.
Figure 9:
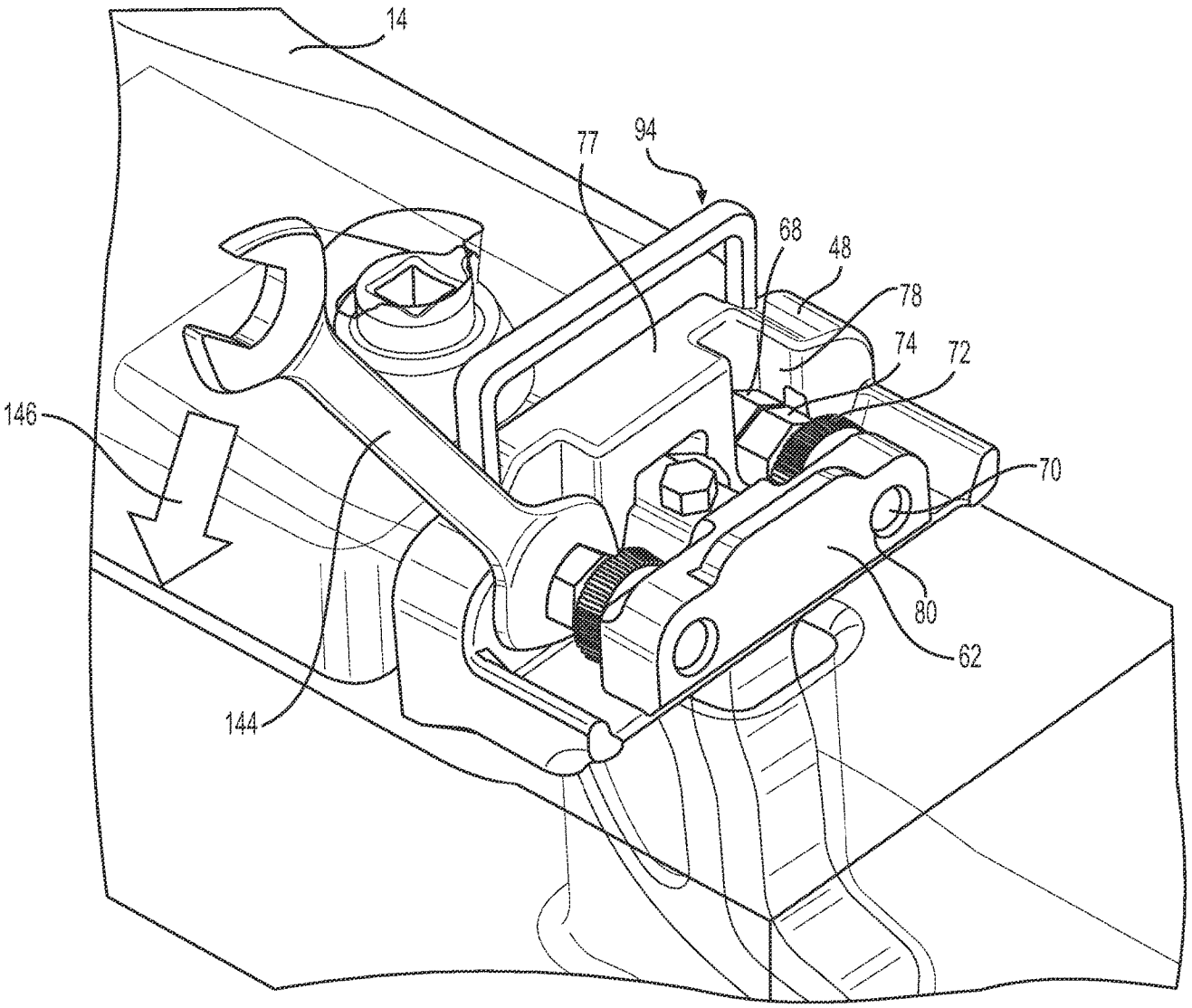
FIG. 9 illustrates a perspective view showing aspects of a wear member retention system according to disclosed embodiments.

FIGS. 8 and 9 are additional views with FIG. 8 illustrating finger tightening of thumb nuts 72 by rotation in the direction of arrows 142, for example, while wear member engaging protrusion 60 is engaged in aperture 34 of a wear member 14. Heads 68 of compression bolts 66 may engage firmly against recesses 78 (FIG. 9) within head element 48 while thumb nuts 72 are rotated on threaded shafts 70 and against compression bolt engaging portion 62. A result of rotation of thumb nuts 72 in this fashion is that wear member 14 may be effectively and efficiently pulled on to lip portion 16 of bucket 12 while bolts 66 are under compression between head element 48 of boss 42 and compression bolt engaging portion 62 of lug member 44.

FIG. 9 is illustrates a situation wherein thumb nuts 72 have been finger tightened to a desired position against compression bolt assembly engaging portion 62 of lug member 44 so that wear member 14 has been pulled back onto lip portion 16 of bucket 12 to the desired extent. At this point, jam nuts 74 may be tightened by a suitable tool 144 for rotation in the direction of arrow 146, for example, so that thumb nuts 72 may be locked in position against inadvertent loosening. FIGS. 8 and 9 also illustrate an alternative form for recesses 78 wherein recesses 78 may be open to a surface 77 of head element 48.

INDUSTRIAL APPLICABILITY

Disclosed embodiments of wear member retention system 26 may be applicable to various earth-working machines, such as wheel loaders, cable shovels, drag lines, electric rope shovels (ERS), excavators, and front shovels, and other machines that include implements generally used for digging into, ripping, or otherwise moving earth, rocks, debris, or other materials. Presently disclosed embodiments of wear member retention system 26 require no welded-on parts and include no parts that must be forced in place by hammering. In addition to being both weldless and hammerless, presently disclosed embodiments of wear member retention system 26 may be employed with existing wear members and on buckets and other implements that include existing lip holes (e.g., lip holes provided for retaining various existing ground engaging components) without modification. Because the disclosed wear member retention system employs a compression bolt assembly including bolts that exert and maintain compression forces to pull back and secure a wear member onto a lip of an implement instead of tension forces, the system is much less subject to bolt failure.

Boss 42 may include a leg element 50 that is profiled for ease of insertion into and removal from an implement aperture, such as, for example, aperture 36 of bucket 12. For example, first portion 118 of leg element 50 of boss 42 may include an installation recess 136 on a proximal side 138 of boss 42. Installation recess 136 may include a concave curved surface portion, for example third curved surface portion 126, having a radius of curvature that is optimized to aid installation of boss 42. At the same time, leg element 50 is robustly dimensioned for stiffness to enhance resistance to stress failure. Accordingly, ease of insertion of leg element 50 of boss 42 into aperture 36 may be gained without compromising stress failure resistance of boss 42.

The unique shape and cooperating arrangement of boss 42 and lug member 44 permit the use of one or more compression bolts 66 to exert a force pulling back and retaining a wear member 14 on the lip 16 of an implement 10 that places bolts 66 under compression rather than under tension. As a result, the bolts are more enduring and less apt to fail. Advantageously, the disclosed compression bolt assembly 46 makes it possible to exert sufficient force to pull back and retain a wear member 14 using nuts for the compression bolts 66 that do not require tools. Thus, thumb nuts 72 may be used to manually adjust the wear member retention system 26.

Use of the term "generally," within this specification, (e.g., generally perpendicular, generally equal, generally planar, etc.) is intended to take into account those situations wherein the components and relationships referenced may deviate from an absolute by normal and accepted industry manufacturing tolerances.

It will be apparent to those skilled in the art that various modifications and variations can be made to the disclosed wear member retention system. Other embodiments will be apparent to those skilled in the art from consideration of the specification and practice using the disclosed wear member retention system. It is intended that the specification and examples be considered as exemplary only, with a true scope being indicated by the following claims and their equivalents.

What is claimed is:

1. A lug member configured for retaining a wear member that is separate from the lug member on an implement, the lug member comprising:

an elongated body having a length dimension, wherein the elongated body includes:

a lower surface extending from a proximal end to a distal end of the elongated body, the lower surface being configured to engage with a surface of a boss member that is separate from the implement, and an upper surface configured to engage with the wear member; and a compression bolt assembly engaging portion adjacent the proximal end of the elongated body, wherein the compression bolt assembly engaging portion is configured to receive a compressive force having a directional component pointed from the distal end of the elongated body toward the proximal end of the elongated body and exerted on the compression bolt assembly engaging portion by an internally threaded member threadedly received on a compression bolt.

2. The lug member of claim 1, wherein the compression bolt assembly engaging portion defines at least one unthreaded bore.

3. The lug member of claim 2, wherein the compression bolt assembly engaging portion is configured to receive the compressive force exerted on the compression bolt assembly engaging portion by each of two nuts threadedly received on two respective compression bolts.

4. The lug member of claim 2, wherein the compression bolt assembly engaging portion defines two unthreaded bores each configured to receive a threaded shaft of a compression bolt.

5. The lug member of claim 1, wherein the compression bolt assembly engaging portion includes a transverse member extending generally perpendicular to the length dimension of the elongated body, and wherein the transverse member includes a surface facing the distal end of the elongated body and configured to receive the compressive force.

6. The lug member of claim 5, wherein the transverse member includes a first lateral arm extending a first distance from a first lateral side of the lug member, and a second lateral arm extending a second distance from a second lateral side of the lug member, the first distance being generally equal to the second distance.

7. The lug member of claim 6, wherein the compression bolt assembly engaging portion is configured to receive the compressive force exerted on the compression bolt assembly engaging portion by two nuts threadedly received on two respective compression bolts.

8. The lug member of claim 7, wherein the compression bolt assembly engaging portion defines two unthreaded bores each configured to receive an end of one of the compression bolts.

9. The lug member of claim 8, wherein the first lateral arm defines a first one of the two unthreaded bores and the second lateral arm defines a second one of the two unthreaded bores.

* * * * *